US007958820B2

(12) United States Patent
Duperon

(10) Patent No.: US 7,958,820 B2
(45) Date of Patent: Jun. 14, 2011

(54) COMPACTOR CONSTRUCTION

(75) Inventor: Terry L. Duperon, Saginaw, MI (US)

(73) Assignee: Duperon Innovation, Inc., Saginaw, MI (US)

( * ) Notice: Subject to any disclaimer, the term of this patent is extended or adjusted under 35 U.S.C. 154(b) by 23 days.

(21) Appl. No.: 12/006,853

(22) Filed: Jan. 7, 2008

(65) Prior Publication Data

US 2008/0105141 A1 May 8, 2008

Related U.S. Application Data

(63) Continuation-in-part of application No. 11/497,821, filed on Aug. 2, 2006, now abandoned.

(51) Int. Cl.
*B30B 9/16* (2006.01)

(52) U.S. Cl. ..... 100/117; 100/145; 100/146

(58) Field of Classification Search ..... 100/117, 100/145, 146, 147, 337, 338
See application file for complete search history.

(56) References Cited

U.S. PATENT DOCUMENTS 2,119,162 A 5/1938 Hartner
3,064,557 A 11/1962 Ginaven
3,064,908 A * 11/1962 Hjelte ..... 241/252
3,215,355 A * 11/1965 Shouvlin et al. ..... 241/247
3,450,034 A 6/1969 Ocker
3,460,466 A * 8/1969 Adams et al. ..... 100/117
3,461,793 A 8/1969 Solberg
3,533,563 A * 10/1970 Eriksson ..... 241/28
4,202,773 A 5/1980 Fink et al.
4,393,983 A 7/1983 Eriksson
4,446,094 A 5/1984 Rossiter
4,718,337 A 1/1988 Wiederkehr
4,779,528 A 10/1988 Bruke
5,156,872 A 10/1992 Lee
5,341,826 A 8/1994 Huber et al.
5,390,592 A 2/1995 Schnell et al.
5,417,155 A 5/1995 Tatsuzawa
5,526,740 A 6/1996 Lee
5,611,268 A 3/1997 Hamilton
5,662,035 A 9/1997 Lee
5,906,154 A 5/1999 Yoon et al.
6,550,376 B2 * 4/2003 Johnston ..... 100/146

* cited by examiner

*Primary Examiner* — Jimmy T Nguyen
(74) *Attorney, Agent, or Firm* — Robert L. McKellar; McKellar IP Law, PLLC

(57) ABSTRACT

A compactor for compacting and dewatering debris comprises a housing having an inlet for enabling debris to be delivered to forwarding augers which forward the debris to a compaction chamber at the discharge end of the housing. The chamber has an outlet opening of less cross-sectional area than that of the chamber, thereby ensuring compaction of the debris as it moves toward discharge. Debris enroute to discharge may be sprayed with water to remove sludge-like substances which otherwise would cling to some types of debris.

22 Claims, 8 Drawing Sheets

COMPACTOR CONSTRUCTION

CROSS REFERENCE TO RELATED APPLICATION

This application is a continuation-in-part of application Ser. No. 11/497,821 filed Aug. 2, 2006 now abandoned.

This disclosure relates to apparatus for compacting and dewatering refuse or other compactable material.

BACKGROUND OF THE APPARATUS

It is common practice to install in a flowing stream debris collection apparatus for the purpose of removing trash from the stream so as to avoid such trash entering pumps, clogging screens, or otherwise interfering with or damaging downstream equipment. Examples of such trash collecting apparatus are disclosed in U.S. Pat. Nos. 4,709,804 and 5,425,875.

Trash intercepted and removed from a stream typically is discharged to a collector from which it is conveyed or otherwise transported to a disposal site. Unless the trash is compacted and dewatered, the bulkiness and weight of such trash presents problems in transporting and disposing of such trash.

Apparatus constructed in accordance with the invention compacts and dewaters trash removed from a flowing stream, thereby minimizing the objectionable characteristics of transporting and compacting such trash.

SUMMARY OF THE DISCLOSURE

Trash compaction apparatus constructed in accordance with the presently preferred embodiment of the invention is adapted to be located in a position to receive debris extracted from a flowing stream or other source and operate continuously to compact and dewater such debris substantially simultaneously with its removal from the stream, thereby effecting substantial economies in dealing with such debris.

The compacting apparatus comprises a housing for receiving debris to be compacted, material forwarding means for forwarding the debris toward an outlet in the housing and applying a positive force on such debris as it moves in a direction to be discharged from the housing. The outlet is so constructed and arranged as to apply a resistive force on the debris as it passes through the outlet, thereby enabling the combination of the debris forwarding force and the resistive force to effect compaction of the debris as it approaches and moves through the outlet.

The debris forwarding means comprises a pair of vertically spaced augers each of which has a longitudinally extending shaft on which a helical vane is secured. The two shafts are driven in opposite directions by a common drive motor, but the vanes are of opposite hand so that the augers simultaneously forward debris in the housing toward the outlet. Except for the vanes being of opposite hand the augers of one embodiment are the same, whereas there may be differences in the augers of a modified embodiment. The vertical spacing between the augers is such that the vanes are interleaved with, but do not engage, one another so as to be self cleaning, thereby minimizing the possibility that debris will be able to stall either of the augers.

The augers are rotatably journaled by bearings which normally engage and provide support for those ends of the augers adjacent the housing outlet. However, the augers are displaceable vertically relative to their respective bearings in the event debris is required to pass between the augers or the bearings.

In one embodiment the shaft of one of the augers is coupled to a water source so that compacted material arriving at the housing outlet may be sprayed with water so as to enable certain kinds of debris to be flushed. Alternatively, a water spray may be provided which is independent of the augers.

THE DRAWINGS

Apparatus constructed in accordance with presently preferred embodiments of the invention is illustrated in the accompanying drawings wherein.

THE DISCLOSED EMBODIMENTS

Figure 1:
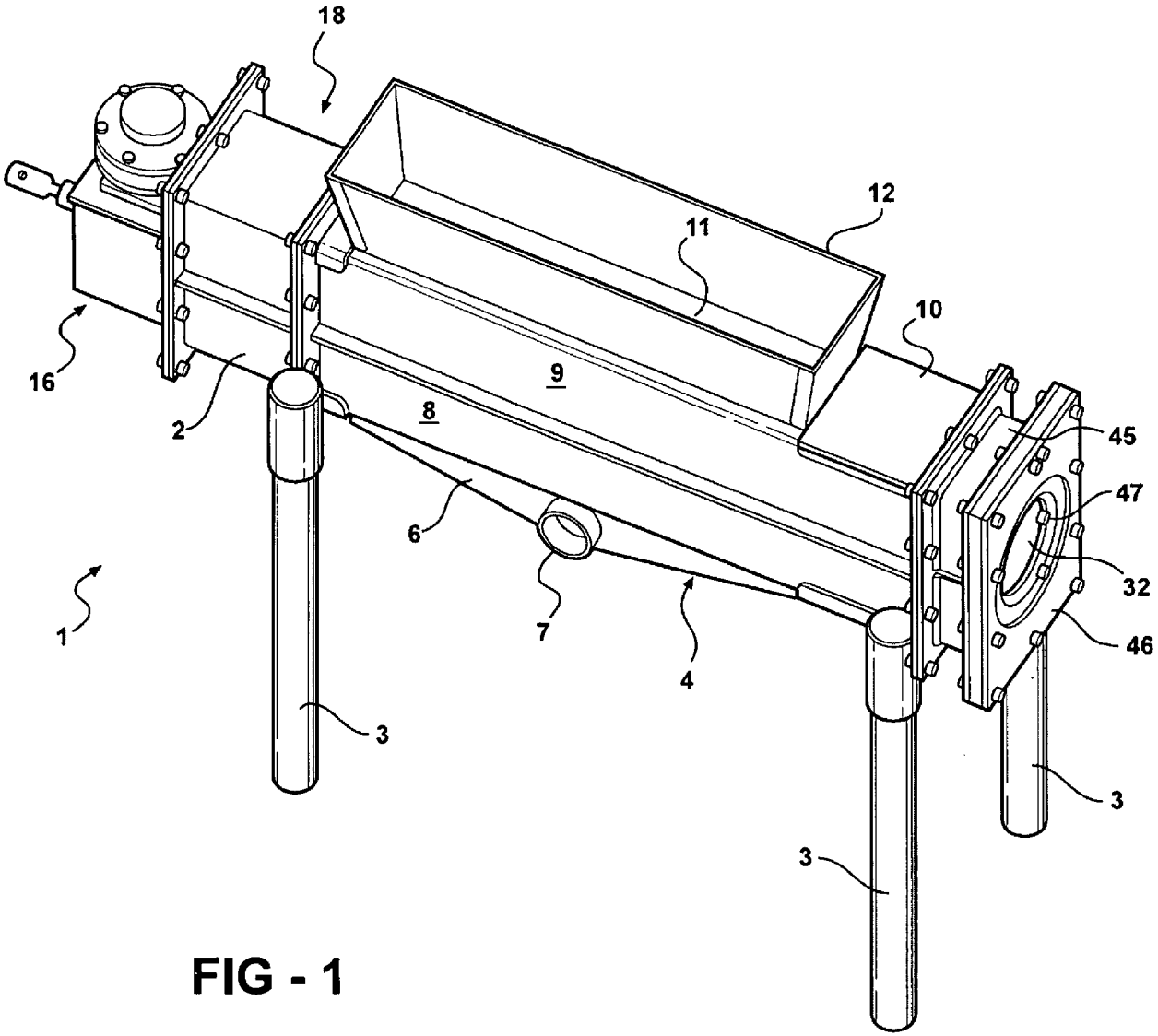
FIG. 1 is an isometric view of one embodiment.
Figure 2:
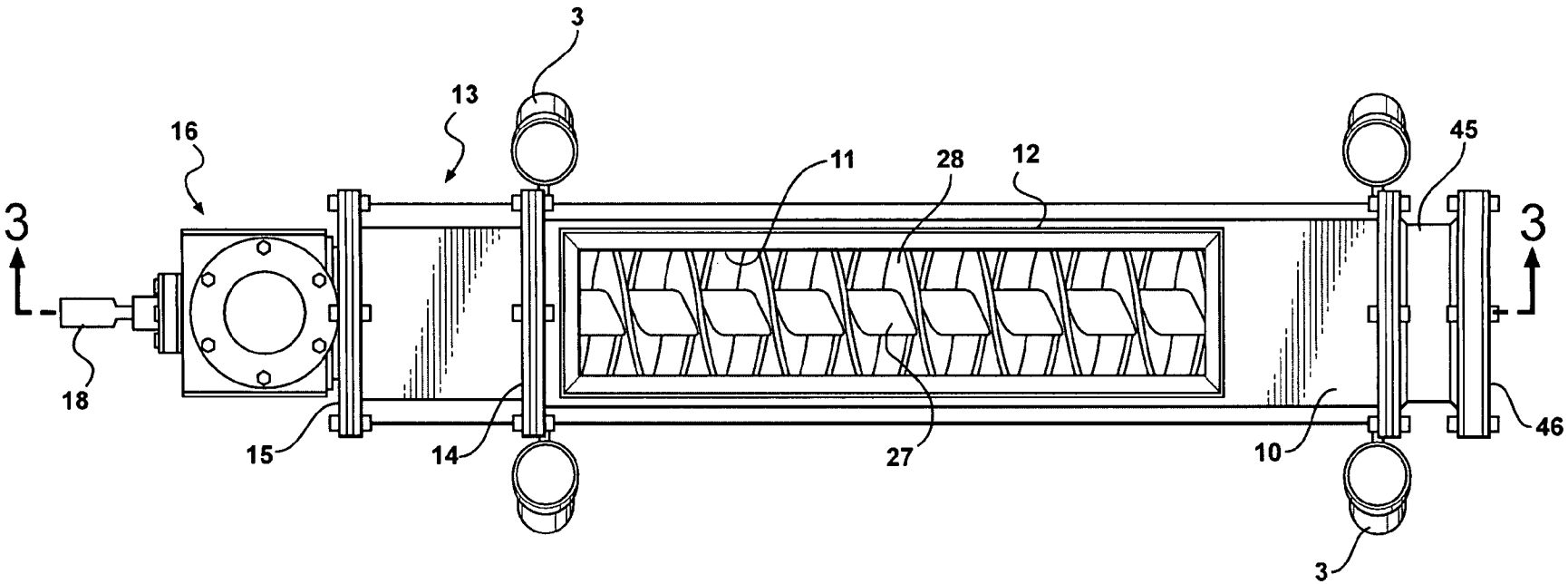
FIG. 2 is a top plan view of such embodiment.

The compacting apparatus illustrated in FIGS. 1-5 is designated generally by the reference character 1 and comprises a frame 2 mounted on supporting legs 3. The frame supports a housing 4 having a downwardly converging bottom 5 and opposed side walls 6. One of the side walls has a drain opening 7. The side walls have upwardly extending extensions 8 and 9 which join a top wall 10 provided with an inlet 11. The inlet is bounded by upwardly extending guides 12 which guide debris (not shown) through the inlet 11 to the interior of the housing 4.

At one end of the housing is an enclosure 13 having end walls 14 and 15, the end wall 14 being bolted or otherwise secured to the housing 4. Bolted or otherwise secured to the end wall 15 is a support 16 for an electric drive motor (not shown) coupled to a gear reduction assembly 17 of known construction having a drive shaft 18 coupled to a driven shaft 19 which extends through a coupling 20 and a gear 21. The gear 21 meshes with a like gear 22 fixed on an offset shaft 23.

The gears 21 and 22 are coupled to debris forwarding means 24 comprising a pair of uniform, vertically spaced augers 25 and 26. The auger 25 has a longitudinally extending shaft 27 which is rockably connected to the shaft 23 in known manner. Fixed on the shaft 27 is a helical vane 28. The auger 26 has a hollow shaft 29 which parallels the shaft 27 and is rockably connected to the shaft 19. The shaft 29 has fixed thereon a helical vane 30. The pitch of the vanes 28 and 30 preferably is uniform. The interior of the hollow shaft 29 communicates with the coupling 20. To the coupling 20 is connected one end of a hose 31 the opposite end of which communicates with a source of water.

Figure 3:
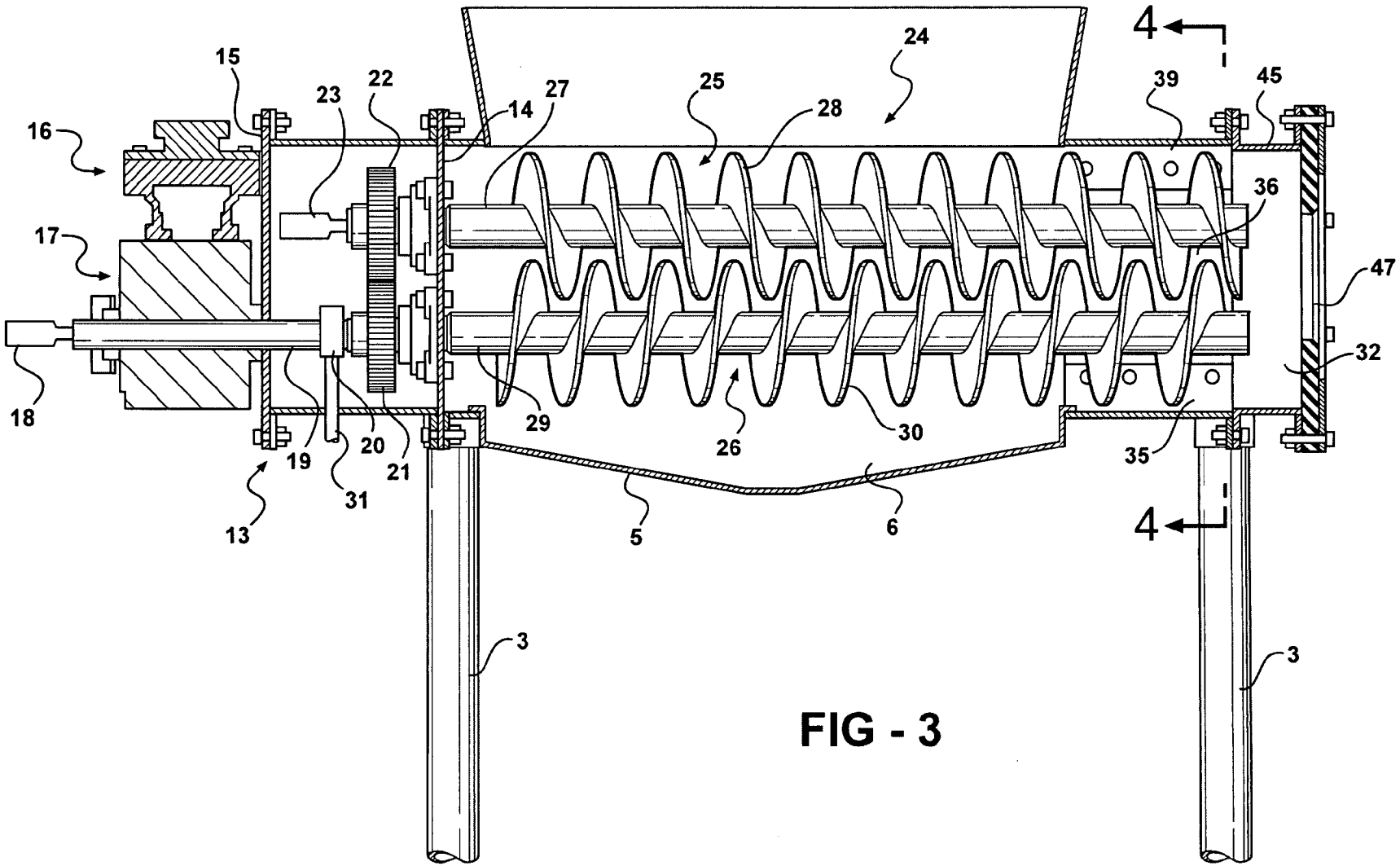
FIG. 3 is a sectional view, on an enlarged scale, taken on the line 3-3 of FIG. 2.
Figure 4:
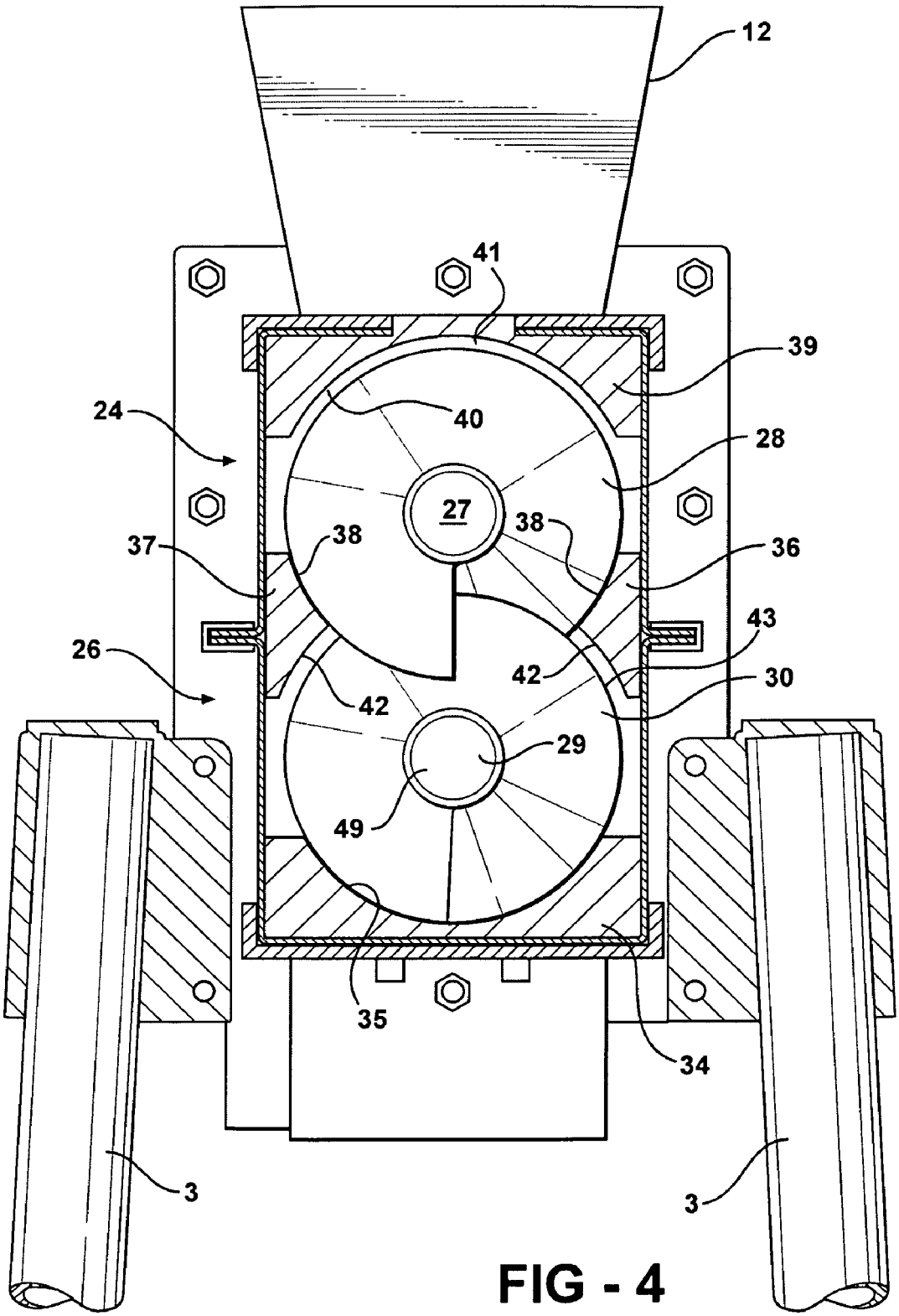
FIG. 4 is a sectional view, on an enlarged scale, taken the line 4-4 of FIG. 3.

As is shown clearly in FIGS. 3 and 4 the vertical spacing between the augers is such that the vanes 28 and 30 are interleaved, but no part of either auger engages any part of the other. The peripheral edge of each vane projects toward, but terminates short of, the shaft of the adjacent auger. The vanes of the augers are axially spaced from one another. The gearing 21 and 22 effects driving of the respective augers in opposite directions. However, the vanes 28 and 30 are of opposite hand and are so assembled with the respective auger shafts that each vane simultaneously may exert a force on compactable material within the housing to forward the latter from left to right, as viewed in FIG. 3, and toward a compaction chamber 32 at that end of the housing remote from the driving gears 21 and 22. The construction and arrangement of the augers are such that the augers are self cleaning.

Auger bearing means are provided adjacent the discharge end of the housing 4. The bearing for the lower auger 26 comprises a block 34 (FIG. 4) of bearing material having an upwardly concave surface 35 formed on the same radius as that of the vane 30 and occupies a position to provide support from below for one or more convolutions of the vane 30. At a level above the bearing block 34 are two laterally spaced bearing blocks 36 and 37. Each of these blocks has an upper arcuate surface 38 formed on an arc corresponding to the radius of the vane 28. One or more convolutions of the vane 28 normally rest upon and are supported from below by the bearing blocks 36 and 37.

At a third level is a bearing block 39 which corresponds substantially to the block 34 except that the block 39 overlies the vane 28 of the upper auger 24. The block 39 has an arcuate surface 40 formed on an arc corresponding to the radius of the vane 28. The bearing block 39 does not normally bear upon the vane 28. Instead, there normally is a clearance 41 between the periphery of the vane 28 and the arcuate surface 40 of the block 39.

Each of the bearing blocks 36 and 37 has a downwardly facing arcuate surface 42. The position of the bearing blocks 36 and 37 is such that, normally, the periphery of the lower auger vane 26 is spaced from the arcuate surfaces 42 by a clearance 43.

As has been mentioned earlier, at the discharge end of the housing 4 is a compaction chamber 32 formed by closure walls 45. That end of the chamber which confronts the augers is open, whereas the opposite end is partially closed by a closure wall or block 46 formed of a known elastic, rubbery material having a central outlet opening 47 therein. The opening 47 has its center at the longitudinal axis of the chamber 32, but the cross-sectional area of the outlet opening 47 is less than that of the chamber.

At the free end of the hollow auger shaft 29 is a nozzle 49 which is inclined so as to be able to spray water which traverses the shaft 29 in the direction of the closure block 47.

In the operation of the apparatus thus far described the housing is so positioned that the inlet 11 defined by the guide walls 12 is in a position to receive debris. It is contemplated that the apparatus will be used in conjunction with a self cleaning trash rack of the kind shown in the aforementioned patents which can be placed in a flowing stream in such manner as to intercept trash and lift it from the stream to a position in which it is discharged automatically to the inlet 11. However, the apparatus disclosed herein can be used for compacting any kind of compactable material.

Debris entering the housing via the inlet 11 is entrained by the augers 25 and 26 which, when rotated, forward the entrained debris along a path in the direction of the chamber 32. As the debris is forwarded toward the chamber the debris is dewatered and compacted to some extent simply by its engagement with and movement by the augers. Eventually, debris reaches the discharge end of the housing and is introduced to the chamber 32. The debris soon will fill the chamber. The only escape path for the debris is through the outlet opening 47 in the closure block 46. Since the cross-sectional area of the opening is less than that of the chamber 32, debris introduced to the chamber 32 will be dewatered and compacted in the chamber until such time as the continuing admission of debris into the chamber causes the debris to force its way to the opening 47.

Figure 5:
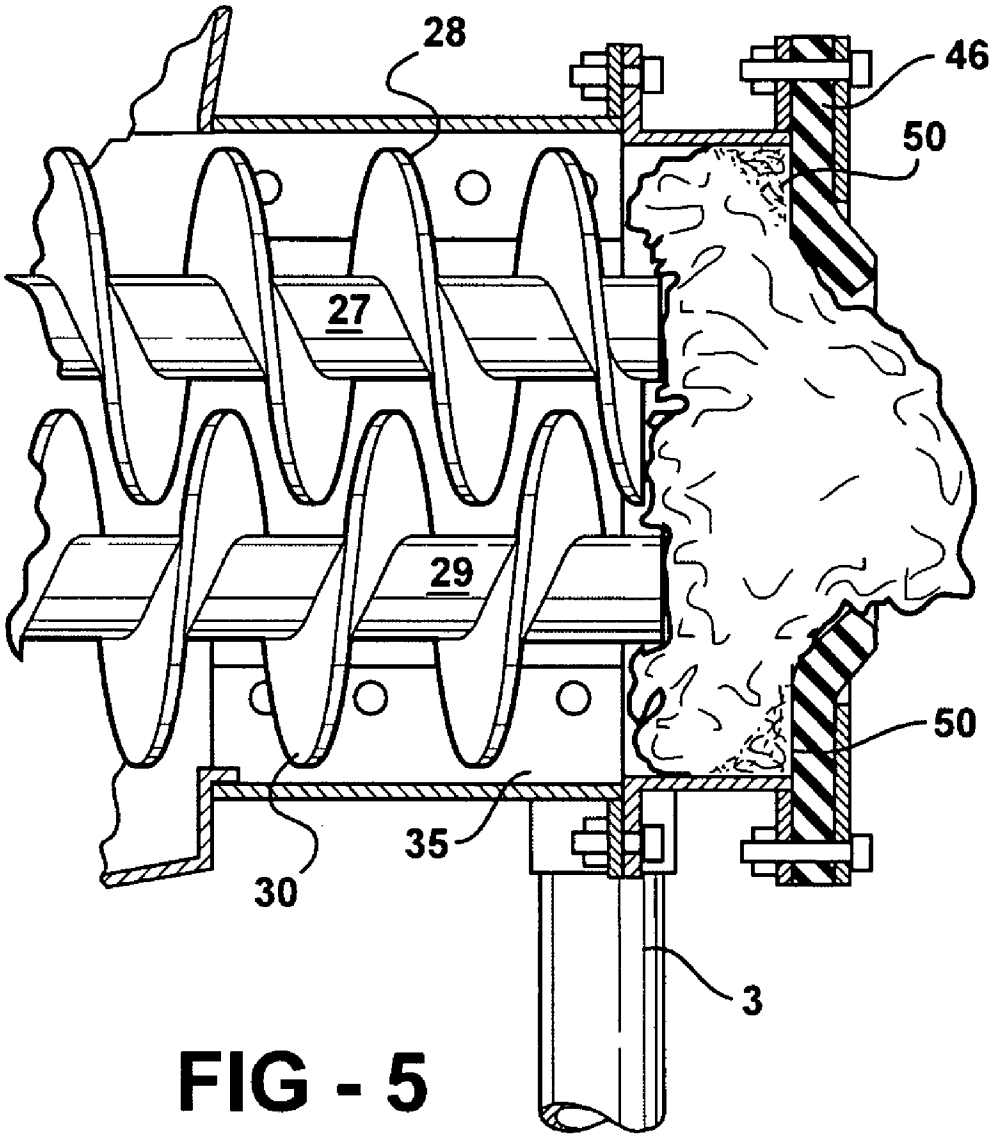
FIG. 5 is a fragmentary sectional view, on an enlarged scale, illustrating in greater detail the outlet end of the apparatus.

Since the quantity of debris introduced to the chamber has a larger cross sectional area than that of the opening 47, debris in the chamber will continue to be compacted. Eventually, the compacted material will force its way through the opening 47 and, in the process of passing through the opening, will displace the edges of the block adjacent the opening outwardly, or to the right as is indicated in FIG. 5. The elasticity of the block 46 will impose a yieldable resistive force on compacted material entering the opening 47, thereby further compacting the debris as it passes through the opening.

As the material continues to be forwarded to the chamber 32, it will fill the chamber in such manner as to form a tapered passageway 50, indicated in FIG. 5, through the chamber to the outlet opening 47. The compacted material forming such passageway will become virtually solid, thereby cooperating with the closure 46 to concentrate compaction of the debris as it is forced to move toward the outlet opening.

Trash in waste water streams frequently includes rags and textile materials which have a tendency to wrap around an auger shaft or vane. Should this occur the textile materials still will be forwarded to the compaction chamber 32. If a rag has become wrapped around a vane, it is possible for the rag to effect lifting of either or both of the augers off their respective bearing blocks a distance corresponding to the clearances 41 and/or 42, thereby enabling the rag to pass between the bearings and the vanes without stalling the augers. The flexibility of the auger shafts is such as to permit the necessary vertical movements of the augers.

As the debris is compacted it also is dewatered. The water thus released from the debris may escape the housing through the discharge opening 7.

Some kinds of debris are sludge-like in form and will adhere to compacted debris. To minimize the sludge-like content of debris which is discharged from the compacting apparatus water may be sprayed from the nozzle 49 as the auger 26 rotates, thereby washing such sludge-like material from the compacted debris.

Figure 6:
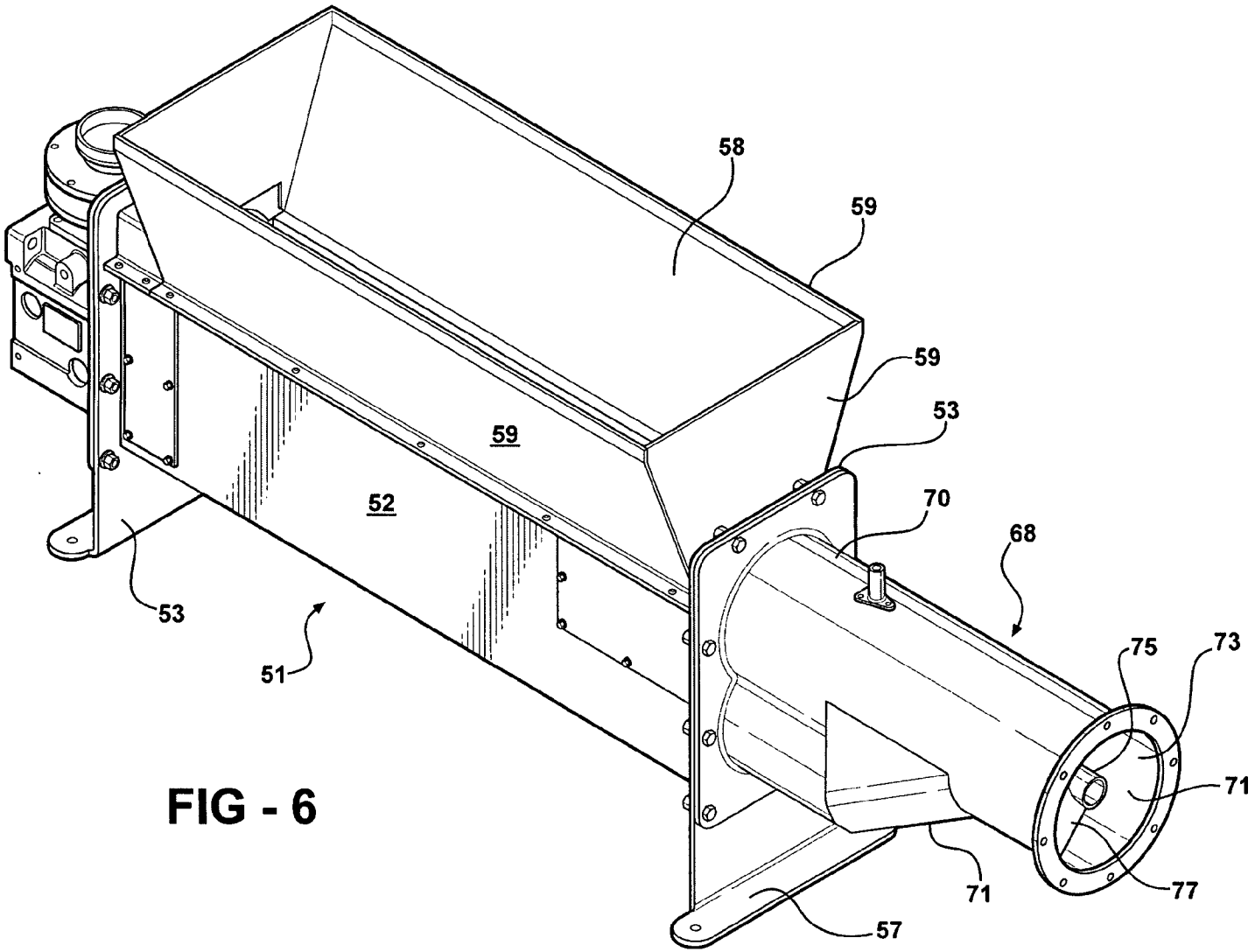
FIG. 6 is an isometric view of a second embodiment.
Figure 7:
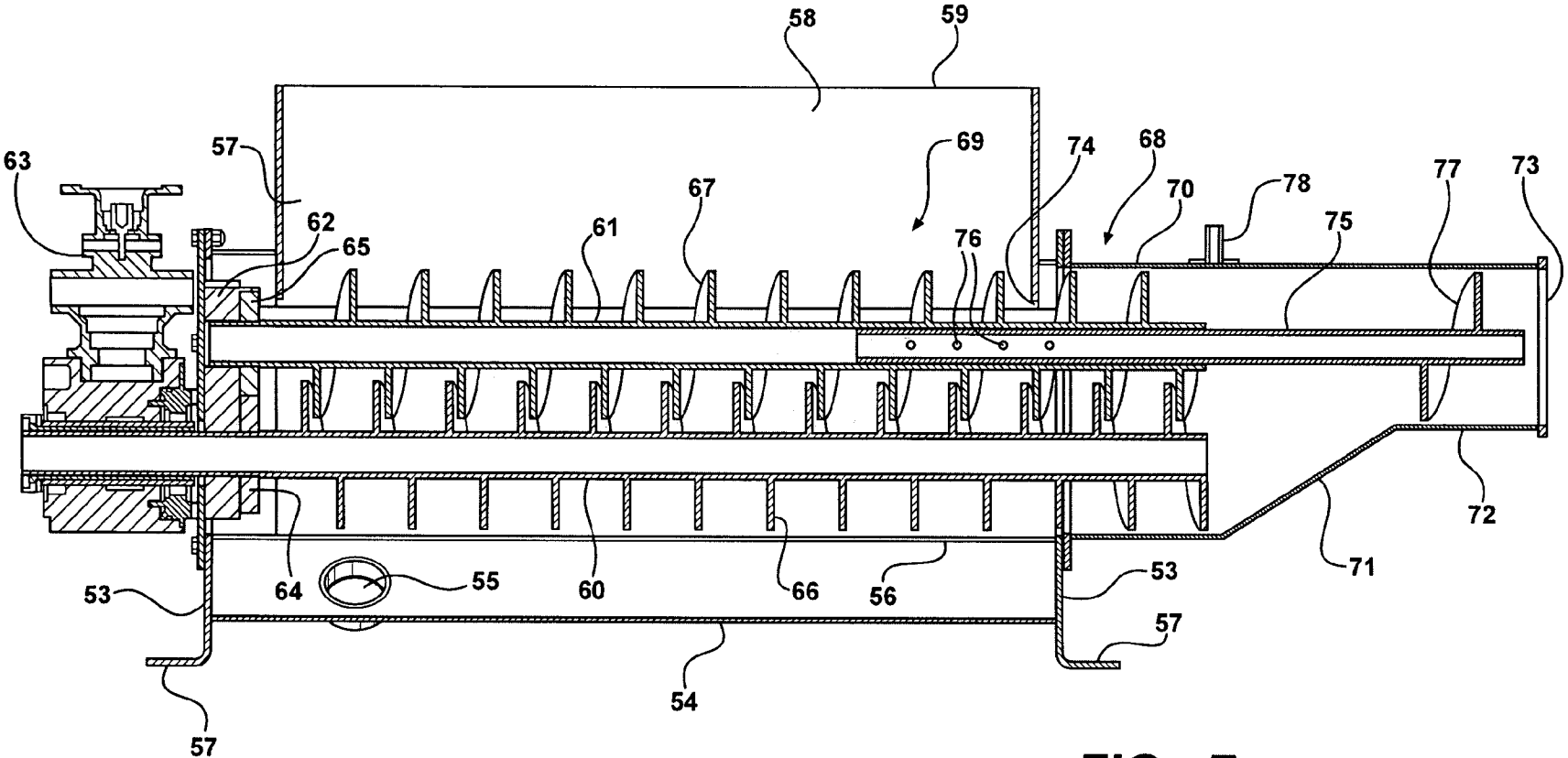
FIG. 7 is a sectional view of the embodiment of FIG. 6.
Figure 8:
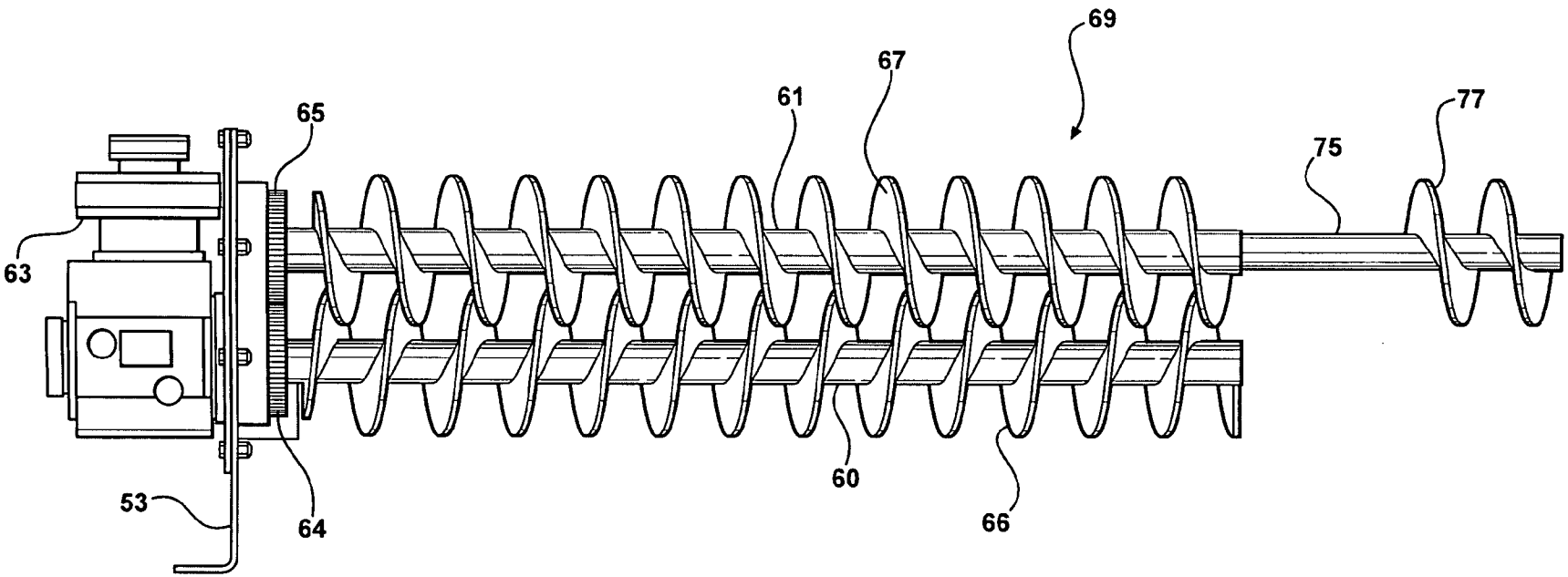
FIG. 8 is an elevational view of the augers incorporated in the second embodiment.

The embodiment shown in FIGS. 6-8 is similar in many respects to the embodiment just described. However, there are differences, and such differences and the reasons therefor will be explained.

The embodiment of FIGS. 6-8 comprises a housing 51 having sidewalls 52, end walls 53 and a bottom 54 provided with a discharge opening 55 therein. A screen 56 is supported in a position slightly above the bottom wall 54. The end walls 53 terminate in flanges 57 by means of which the housing may be mounted on a support (not shown) in a position to enable debris to be delivered to the housing. The housing 51 has an inlet 58 at its upper end which is bounded by upwardly extending guides 59 which guide debris (not shown) through the inlet to the interior of the housing.

Accommodated in the housing is a pair of vertically spaced forwarding auger shafts 60 and 61. At one end of the housing is a journal 62 in which is journaled adjacent ends of the auger shafts 60 and 61. Also mounted at the same end of the housing is a support 63 for an electric motor (not shown) coupled through a gear reduction assembly to one end of the auger shaft 60 so as to impart rotation thereto in a selected direction. The shaft 60 has secured thereto a drive gear 64. A similar driven gear 65 meshes with the drive gear 64 so that rotation of the shaft 60 will effect rotation of the shaft 61, but in the opposite direction.

Fixed to the auger shaft 60 is a helical vane 66, and a similar vane 67 is fixed to the auger shaft 61. The vanes 66 and 67 preferably are of equal pitch, but are of opposite hand so that when rotated, the vanes will forward material from the housing toward a compaction chamber 68 secured to the end wall 53 of the housing at that end of the latter opposite the mount for the diving motor. The vanes are interleaved and fairly closely spaced to one another, but do not engage, thereby enabling the vanes to be self cleaning in response to their rotation.

The auger shafts and their respective vanes constitute material forwarding means 69 for forwarding debris from the housing 51 to the chamber 68.

The vanes of the respective auger shafts are supported from below by bearings corresponding to those described in connection with the embodiment shown in FIGS. 1 and 5. Overlying bearings for limiting relative vertical movement of the auger shafts also are provided for the purpose set forth in connection with the description of the first embodiment. However, to avoid undue crowding of the illustration of the components of the embodiment of FIGS. 6-8 the lower and upper bearings are not shown in the drawings.

The compaction chamber 68 comprises a hollow body having adjacent the discharge end of the housing 51 a cylindrical section 70 for the accommodation of the ends of the auger shafts and vanes. See FIG. 7. Downstream of the section 70 (i.e., in the direction of movement of the debris) the compaction chamber has an upwardly inclined lower wall 71 which terminates in a cylindrical passageway 72 having a discharge opening 73 therein. The cross-sectional area of the passageway 72 is substantially less than that of the compaction chamber 68, thereby ensuring compaction of debris as it passes from the compaction chamber to the passageway.

As is shown clearly in FIG. 7 the auger shafts 60 and 61 and their respective vanes 66 and 67 extend through an opening 74 in the end wall 53 of the housing and for a short distance into the interior of the compaction chamber 68. As a consequence, material to be compacted which enters the housing via the inlet 58 will be engaged by the vanes of the augers and forwarded to the compaction chamber 68. As the compaction chamber fills with debris, the continued introduction of debris into such chamber will cause the debris to be moved toward the passageway 72. Such action will reduce the volume of the debris as it moves toward the outlet opening 73 and such reduction in volume will effect compaction of the debris.

The degree of compaction of the debris in the compacting chamber may be controlled to some extent by the provision of an auxiliary auger 75. As is shown clearly in FIG. 7, the auger shaft 61 is hollow and the auxiliary auger shaft 75 is of such diameter as slideably to be accommodated in the shaft 61. Aligned openings in the shafts 61 and 75 may accommodate bolts 76 so as to enable the distance the auxiliary auger 75 projects beyond the auger shaft 61 to be adjustable.

The auxiliary auger shaft 75 is provided at that end adjacent the outlet opening 73 with a pair of helical vanes 77 which are similar to the vanes 66 and 67 except that the vanes 77 are formed on a higher pitch. The rate of rotation of the extension shaft 75 and its vanes 77 is the same as that of the auger shaft 61, but because of the higher pitch of the vanes 77 whatever material is engaged by such vanes will be moved through the passageway formed by the section 72 toward the outlet opening 73 at a greater velocity than the material engaged by the auger vanes 66 and 67. This characteristic of the construction, coupled with the axial adjustability of the auxiliary auger 75 make it possible to control the degree of compaction of the material which occupies the outlet passageway. For example, if material discharged to the compaction chamber 68 is of such nature that the compaction of such debris within the outlet passageway 72 tends to clog the passageway, the auxiliary auger 75 may be moved to the left, as viewed in FIG. 7, thereby placing the vanes 77 somewhat closer to the inlet end of the outlet passageway. This positioning, coupled with the higher pitch of the vanes 77, will enable material in the outlet passageway to be accelerated in its movement through the outlet opening 73, thereby avoiding such compaction of debris in the passageway to such an extent as to risk stalling of the augers.

At a position corresponding substantially to the ends of the auger vanes 66 and 67, the compaction chamber 68 is provided with a nozzle 78 which may be coupled to a source of water. Such water may be sprayed through the nozzle 78 onto the debris as it commences compaction so as to wash such debris and remove the sludge-like content of the debris. Such wash water, together with any water which is removed from the debris in the compaction stage will flow down the inclined wall 71 and through the screen 56 for removal through the opening 55 at the bottom of the housing.

Compacted debris discharged from either embodiment of the apparatus will be in log-like form which will occupy considerably less space than uncompacted debris would occupy and is considerably more solid than uncompacted debris. Such debris therefore lends itself well to placement in landfills and can be transported more easily by truck with fewer trips than otherwise would be required with uncompacted debris.

The disclosed embodiments are representative of presently preferred forms of the invention, but are intended to be illustrative rather than definitive thereof. The invention is defined in the claims.

I claim:

1. A compactor construction comprising a housing having an inlet for receiving material to be compacted; a compaction chamber in communication with said inlet for receiving said material and in which said material may be compacted, said chamber having an outlet through which compacted material may be discharged; a pair of adjacent forwarding augers within said housing having interleaved helical vanes, said augers being spaced from one another a distance to avoid contact between said augers, including bearing means carried by said housing and underlying the vanes of the respective augers for engagement by said vanes, thereby supporting said augers from below; drive means coupled to said forwarding augers for driving the latter in a direction to forward material in said housing along a path toward said compaction chamber and said outlet; and resistance means at the outlet of said compaction chamber comprising a wall formed of elastic material having an opening therein through which compacted material from said chamber may pass for imposing a compaction force on said material as such material moves along said path through said compaction chamber and through said outlet thereby enabling material in said housing enroute to and through said outlet to be compacted by said forwarding augers.

2. The construction according to claim 1 wherein each of said augers is vertically movable a distance sufficient to enable each said auger to be lifted off the underlying bearing means.

3. The construction according to claim 2 including additional bearing means carried by said housing, said additional bearing means overlying and being spaced from the respective vanes of said augers to limit said vertical movement of said augers.

4. The construction according to claim 1 wherein said chamber has a wall provided with an opening therein, said chamber and said opening having respective cross-sectional areas, the cross-sectional area of said opening being less than that of said chamber.

5. The construction according to claim 4 wherein said wall is formed of elastic material enabling said opening resiliently to be expanded in cross-sectional area in response to the passage of compacted material therethrough, the expansion of said opening contributing to resistance to the movement of said material through said outlet.

6. The construction according to claim 4 wherein said chamber communicates with a passageway into and through which compacted material from said chamber may pass, said passageway having a cross-sectional area less than that of said chamber.

7. The construction according to claim 6 including auxiliary rotary auger means extending into said passageway for assisting movement of compacted material in said passageway through said passageway.

8. The construction according to claim 7 wherein each of said forwarding auger means has a helical vane of selected pitch and wherein said auxiliary auger means includes a helical van having a pitch greater than that of the vanes of said forwarding auger means.

9. The construction according to claim 7 wherein one of said forwarding auger means includes a shaft and wherein said auxiliary auger means includes a shaft carried by and axially extensible and retractable relative to said shaft of said one of said forwarding auger means.

10. A compactor construction comprising a housing; means forming an inlet into said housing for receiving material to be compacted; means forming an outlet from said housing through which compacted material may be discharged; material forwarding augers adjacent one another within said housing, each said auger including a helical vane, the vane of each auger being interleaved with the vane of the adjacent auger but free of engagement with the vane of the adjacent auger; auger drive means for simultaneously driving said auger in a direction to move material in said housing along a path toward said outlet; and means forming a chamber in said housing upstream from said outlet into which material forwarded by said augers may be discharged, said chamber having a selected cross-sectional area, said outlet having an elastic cross-sectional area less than that of said chamber, whereby material traversing said chamber in a direction toward said outlet becomes compacted in said chamber.

11. The construction according to claim 10 wherein the means forming said outlet is tubular passageway.

12. The construction according to claim 10 including bearing means carried by said housing in a position to engage and support the vanes of said augers from below.

13. The construction according to claim 12 wherein each said auger has a shaft on which the associated vane is fixed, said shaft being vertically adjustable to enable said shaft to rise a distance to provide clearance between the vane on said shaft and the associated bearing means.

14. The construction according to claim 10 wherein there are two of said augers vertically spaced from one another.

15. The construction according to claim 10 wherein said auger drive means rotates said augers in opposite directions.

16. The construction according to claim 15 wherein the vanes of said augers are of opposite hand.

17. The construction according to claim 13 wherein said vanes are of substantially uniform pitch.

18. The construction according to claim 10 wherein one of said augers has a hollow shaft, means coupling said hollow shaft to a source of water, a nozzle means carried by said hollow shaft for spraying water from said shaft in a direction toward said outlet opening.

19. The construction according to claim 10 wherein one of said augers has an auxiliary auger extending in prolongation of said one of said augers, said auxiliary having a helical vane extending into said outlet.

20. The construction according to claim 19 wherein said auxiliary auger is adjustable axially of said one of said augers.

21. The construction according to claim 19 wherein the helical vane of said auxiliary auger has a pitch different from that of the vane of said one of said augers.

22. The construction according to claim 21 wherein the pitch of the helical vane of said auxiliary auger is greater than that of the vane of said one of said augers.

* * * * *